US005685215A

United States Patent [19]

Jepsen et al.

[11] Patent Number: 5,685,215

[45] Date of Patent: Nov. 11, 1997

[54] HYDRAULIC PISTON ENGINE DRIVEN BY A LUBRICANT-FREE, WATER-BASED FLUID

[75] Inventors: Hardy Peter Jepsen, Nordborg; Flemming Klynder, Padborg, both of Denmark

[73] Assignee: Danfoss A/S, Nordborg, Denmark

[21] Appl. No.: 652,588

[22] PCT Filed: Dec. 5, 1994

[86] PCT No.: PCT/DK94/00454

§ 371 Date: Aug. 12, 1996

§ 102(e) Date: Aug. 12, 1996

[87] PCT Pub. No.: WO95/16129

PCT Pub. Date: Jun. 15, 1995

[30] Foreign Application Priority Data

Dec. 8, 1993 [DK] Denmark ..... 1374/93

[51] Int. Cl.[6] ..... F01B 3/00

[52] U.S. Cl. ..... 92/71; 92/72; 92/153; 92/154; 91/491; 91/499; 417/269; 74/60

[58] Field of Search ..... 92/12.1, 12.2, 92/71, 72, 153, 154; 91/499, 504, 491; 417/269; 74/60

[56] References Cited

U.S. PATENT DOCUMENTS

| | | | |
|---|---|---|---|
| 3,838,942 | 10/1974 | Pokorny | 417/269 |
| 3,872,775 | 3/1975 | Clerk | 91/486 |
| 3,964,323 | 6/1976 | Seibert | 74/60 |
| 5,055,004 | 10/1991 | Ebbing et al. | 92/12.2 |
| 5,450,823 | 9/1995 | Istomin | 123/56.3 |

*Primary Examiner*—Thomas E. Denion

*Attorney, Agent, or Firm*—Lee, Mann, Smith, McWilliams, Sweeney & Ohlson

[57] ABSTRACT

A hydraulic piston engine driven by a lubricant-free, water-based pressure fluid, and comprising an enclosing housing and a piston-connected drive shaft supported by radial journal bearings in bearing bushings. One of the sliding surfaces of the radial journal bearing comprises a recess with a bearing-supporting hydrostatic pressure fluid pocket. The center of the recess is displaced by an angle (α) in the direction against the direction of rotation of the drive shaft, seen in relation to the geometrical, radial mean point in the high-load area for transmission of the piston forces to the bearing surface via the drive shaft. Hereby a particularly reliable piston motor of the type indicated is provided.

21 Claims, 3 Drawing Sheets

HYDRAULIC PISTON ENGINE DRIVEN BY A LUBRICANT-FREE, WATER-BASED FLUID

BACKGROUND OF THE INVENTION

The present invention relates to a hydraulic piston engine for operation with a lubricant-free, water-based pressure fluid, with a rotatable shaft, which is coupled to work pistons and journalled in a housing with at least one radial journal bearing, in which a first sliding surface of metal turns faces a second sliding surface of plastic material.

From EP 0 512 138 a hydraulic piston pump is known of the type mentioned in the introduction, where the drive shaft is made of metal, and the bearing liners of the radial journal bearings are made of a highly stable plastic material on polyetheretherketone basis. The piston pump further comprises pistons of metal, which are supported in cylinder bushings of the plastic material mentioned, with an intermediary, well-defined annular gap, which ensures a passing flow of cooling water in operation. Further, the pump shaft comprises cooling bores for admission of water to the radial journal bearings. However, the publication supplies no directions towards solving the problems concerning the radial journal bearings, which have proved to appear in practice when the pump must be operated at high pressures and/or high rotational speeds.

In practice is has not yet proved possible to achieve operational reliability with known, hydraulic piston engines which are driven by a lubricant-free, water-based pressure fluid. Especially during start and at high bearing loads have the motors been subject to failure. The development effort has mainly been concentrated on choice of materials for the facing sliding surfaces of the radial journal bearings with a view to reducing the friction between them.

The hydraulic piston engine according to the present invention is characterised in that in the journal bearing in a load area, which by the influence of the work pistons during operation is continuously loaded with a radial force, at least one recess has been made in one of the sliding surfaces, which recess is supplied with pressure fluid during operation for at least partial absorption of the radial force, and that the areal centre of gravity of this recess has been angularly displaced in the direction against the direction of rotation of the shaft in relation to a certain position determined by the geometry of the engine, which position indicates the areal centre of gravity for an area where the radial load from the work pistons would exist on the sliding surface in question, if the journal bearing was without friction and without recess. In this manner a hydraulic piston motor is obtained, which is driven by a lubricant-free, water-based pressure fluid, and which appears particularly reliable in operation, particularly during start and at high bearing loads.

For hydraulic piston engines it is known that a permanent high-load area exists at one of the facing sliding surfaces of the radial journal bearing as a consequence of the stationary, static load condition of drive shaft or bearing liner during operation of the piston engine in question, not considering a frictionally conditioned stress by direct contact between the bearing surfaces. The high-load area comprises geometric, radial extreme points for the transmission of the piston forces to the bearing surface via the drive shaft at the smallest, respectively the highest number of pressure-activated pistons for the motor in question. In the case of an axial piston motor, the high-load area is situated on the sliding surface of the bearing liner, and in the case of a radial piston motor, the high-load area is situated on the sliding surface of the drive shaft.

The design according to the present invention reduces the frictional load, and thereby the mechanical wear in the journal bearing. Therefore a water-driven hydraulic piston engine according to the invention can achieve a considerably longer life that the design known from EP 0 512 138. This applies in particular to intermittent duty, where the engine is frequently started and stopped.

It must be assumed that among other things the longer life is caused by a reduced surface pressure between the sliding surfaces. In the highest loaded area of the journal bearing, which is permanently subjected to load from the work pistons, part of one sliding surface is replaced by the pressure fluid in the recess, so that surface contact does not occur at all between the sliding surfaces in this area. The immediately surrounding areas are loaded with a lower surface pressure than in the known design. This is particularly advantageous in the start and stop situation, where the surfaces are torn from each other or come to rest against each other, respectively, but it also reduces the friction and thereby the generation of heat during normal operation.

In addition, a certain volume of pressure fluid will leak in during operation between the sliding surfaces from the recess, whereby the surfaces will be separated and cooled. The frictional heat in the bearing is more easily removed by this cooling than by thermal conduction, because the suitable plastic materials are poor thermal conductors.

During the initial operation of a new piston engine, a certain wearing down of irregularities and slight roughness will take place in the surface of the journal bearing surface, which is made of a plastic material. Many of the worn-off, dislocated plastic particles, which are deposited at the same time in the facing journal bearing surface of metal, will contribute in operation to a low-friction sliding between the surfaces. The wearing down will continue until the plastic surface has adapted its shape to the facing metal surface. The adaptation between the bearing surfaces will at the same time give them large contact areas during high loading of the drive shaft, which is the very cause of increased friction and strong heat generation in the known hydraulic piston engines.

SUMMARY OF THE INVENTION

In the case of the hydraulic piston engine according to the present invention, a hydrostatic pressure fluid pocket will be built up continuously in the recess of the journal bearing. The pressure fluid pocket will support and cool the facing sliding surface. At the same time the surface pressure between the sliding surfaces outside the recess ill be essentially reduced, thereby reducing the friction and the resulting frictional heat. By building up a particularly high hydrostatic fluid pressure in the pocket of the recess, the drive shaft can be lifted virtually free of the bearing liner, forming a thin, annular gap between the surfaces, through which cooling pressure fluid from the recess is supplied during operation.

By the design according to the present invention an increased rotational speed can be realised at unchanged operating pressure, or alternatively an increased operating pressure at unchanged rotational speed. This must also be assumed to be a result of the reduced surface pressure and the separating and cooling effect of the pressure fluid supplied.

A further advantage of the design according to the present invention is the easier starting of the engine. It has proved that a hydraulic engine with journal bearings designed according to the invention can yield a considerably higher starting torque than an engine where the journal bearings are not designed in the manner indicated. The easier starting must be assumed to be the result of the essentially reduced bearing friction.

If it is not desirable to exploit these operational advantages, the invention can be used to make the hydraulic engine cheaper, because the reduced mechanical loading and the reduced wear in the journal bearing allow the use of a cheaper plastic material with lower strength properties and higher temperature sensitivity without reducing the performance of the engine.

With the indicated angular displacement of the recess, allowance is made for the relatively high friction in a journal bearing of the type indicated, when it is operating in a water-based, lubricant-free pressure fluid as for example drinking water or sea water. This friction is considerably higher than in oil-lubricated journal bearings.

The angular displacement can be determined on the basis of a calculation that is based on the geometry of the engine. If the journal bearing is considered as completely devoid of friction and without recess, the total applied force from the pistons will result in one of the sliding surfaces being continuously loaded with a resulting radial force. In certain types of engines the direction of the resulting, radial force will remain constant, while in other types of engines it wanders in an area extending around a certain, angular position.

If, for example, the engine in question is an axial piston engine with rotary pistons and a stationary tilted disk, the resulting, radial force will cause a linear contact in fixed relation to the housing on the sliding surface of the axial bearing that is in fixed relation to the housing, in a position which lies opposite the top of the tilting disk. In a radial piston engine with a stationary piston arrangement, which acts upon an eccentric on the shaft, the resulting radial force will cause a linear contact in an area on the sliding surface of the shaft. When the engine is operating, the linear contact wanders back and forth forwards and backwards across the area, which is angularly symmetrical about a position lying 90° before the vertex of the eccentric in the direction of rotation.

However, the friction between the sliding surfaces causes the resulting radial piston force to be superposed by a frictional force, which is perpendicular to the force of the pistons, and is directed against the direction of rotation of the shaft.

The frictional force is proportional to the frictional coefficient of the journal bearing, multiplied by the radial force of the pistons. That the force is perpendicular to the resulting radial piston force is easily seen from the above discussion of linear contact. The linear contact and the resultant friction cause the shaft to tend to run out of the centre and up against its own direction of rotation along the stationary sliding surface, so that it is made to orbit in the bearing against its direction of rotation. This is equivalent to a tangential stress in the linear contact. Thereby the frictional stress is perpendicular to the resulting, radial force of the pistons, pointing counter to the direction of the rotation of the shaft.

Due to the effect of the friction, the radial force of the pistons is therefore deflected from its geometrically determined direction, and at the same time the absolute value of the force is increased. The angular displacement of the recess is therefore determined so that the recess is favourably placed in relation to the total stress on the bearing surfaces resulting from the friction.

By adjusting the angular displacement to the static coefficient of friction of the journal bearing, as indicated in claim 3, the engine can be optimised so that it is easy to start. The static friction which determines the force required for disengaging the sliding surfaces from each other, is essentially higher in journal bearings of the type indicated than the dynamic friction which determines the force required for keeping the sliding surfaces moving in relation to each other. Therefore, an angular placing of the recess adapted to the static friction will relieve the journal bearing optimally at start, but it will also be less efficient during subsequent operation. This embodiment may therefore be chosen in motors where a large starting torque is desirable.

The embodiment according to claim 4 provides optimised bearing relief during operation, but it will be less efficient in the moment of starting. A generally favourable relief of the bearing may be chosen as a compromise between starting relief and operating relief, cf. claim 5.

The application of a recess according to the invention has the effect that the resulting force composed of frictional force and piston force changes direction when the magnitude of the piston force changes. In a hydraulic piston engine, a cyclically varying number of pistons will generally exert forces on the shaft. For example, in an axial piston engine with five pistons, alternately two pistons and three pistons will be pressure loaded.

In certain types of piston engines, the piston force on the shaft also cyclically changes its direction. For example, the piston force exerted on the shaft in a radial piston engine with five stationary pistons will change direction over an angular range of 36°, symmetrically spread around a point lying 90° before the eccentric of the motor. This change of direction of the piston force similarly causes a change of the direction of the compound, resulting force.

The variation mentioned of the direction of the compound force resulting from friction and piston action leaves a certain latitude for placing the recess, cf. claims 7–9.

As an alternative to the angular adaptation of the placing of the recess indicated in claims 7–9, as a compromise one may take up the directional variations in the resulting, radial force by extending the recess sufficiently far beyond the extent of the sliding surface in question, cf. claim 10.

The embodiment according to claim 11 is particularly advantageous when it is desirable to facilitate the starting of the engine without reducing its volumetric efficiency. When the sliding surfaces have been disengaged from each other at the starting of the engine, the pressure fluid in the recess will tend to press the sliding surfaces apart, so that a gap is formed between the sliding surfaces. Journal bearings of the type described are normally designed with a relatively large bearing clearance of up to one or a few tenths of millimeters—considerably larger than in the case of oil-driven hydraulic engines. The potential gap formation will allow a quite considerable pressure fluid flow, considering the low viscosity of water. The throttling causes the pressure in the recess and thereby the gap width to fall with increasing leakage flow, so that the leakage becomes self-stabilising, and may be reduced to an acceptable level.

The embodiment according to claim 12 is particularly simple in production. However, other embodiments may be imagined, where the throttling is effected by a valve arrangement, because the throttling can be made dependant on external parameters such as load, rotational speed, pressure fluid flow, etc.

By the embodiment according to claims 13 and 14 a water-driven hydraulic engine has the particular advantage that it makes the leakage from the recess independent of the general bearing clearance. In addition, an engine designed in this manner will be less sensitive to extraneous loadings of the shaft, which counteract the mechanical load from the work pistons. The movable slide shoe may follow any movements in the bearing, thereby maintaining the width of the leakage gap around the recess constant. In addition, the embodiment with a land around the recess allows a constructional setting of the leakage rate independently of the bearing clearance.

The claims 15 and 16 indicate suitable constructive embodiments. The area ratio between the recess with the surrounding land and the other end surface of the slide shoe, respectively, cf. claim 6, is decisive for the force acting upon the slide shoe in the direction towards the facing sliding surface, and therefore influences the leakage rate and the resulting wear.

In an engine where the shaft is rotatable in relation to the work pistons, and where the journal bearing is a radial bearing, there will normally be an area on a sliding surface on the shaft which is permanently subjected to mechanical load from the pistons. For example, the shaft may be provided with an eccentric, which during the rotation of the shaft is alternately acted upon by the work pistons, as in a radial piston motor. In this case the loaded area in the journal bearing has a firm geometrical position in relation to the eccentric, and is therefore stationary in relation to the shaft, whereas the load on the facing sliding surface in the radial bearing will be rotating. In this situation the invention may be realised as indicated in claim 17.

In the case of an engine where the work pistons rotate synchronously with the rotation of the shaft in a stationary housing, as for example in an axial piston engine, the power transmission from the pistons will normally take place on a reaction surface in fixed relation to the housing, as for example an inclined surface. In this case it will be the stationary sliding surface of the journal bearing that must absorb a permanent mechanical load from the pistons, and in this situation the invention can be realised as indicated in claim 18.

One of the two facing sliding surfaces of the radial journal bearing is of metal, preferably steel, and the other surface of the journal bearing is of a thermoplastic material, especially from the group of highly stable thermoplastic materials based on polyaryletherketone, especially polyetheretherketone (PEEK), polyamine, polyacetaline, polyarylether, polyethylenephthalephthalate, polyphenylenesulphide, polysulphone, polyethersulphone, polyetherimide, polyamidimide, polyacrylate, which may comprise fillers of glass, graphite, polytetrafluoroethylene or carbon, especially in fibre form.

Thus it is possible to produce one of the sliding surfaces of the journal bearing from many different types of plastic materials, including also cheaper plastic materials of inferior structural strength and higher sensitivity to heat than highly stable plastic materials such as polyetheretherketone from the group of constructional plastic materials.

Further, the present invention relates to a particularly advantageous application of the hydraulic piston engine in a hydraulic plant which is driven with water as pressure fluid, and in particular in a hydraulic plant used in a food processing production.

BRIEF DESCRIPTION OF THE DRAWINGS

The invention is explained in the following with reference to the drawing, where.

DESCRIPTION OF THE PREFERRED EMBODIMENTS

Figure 1:
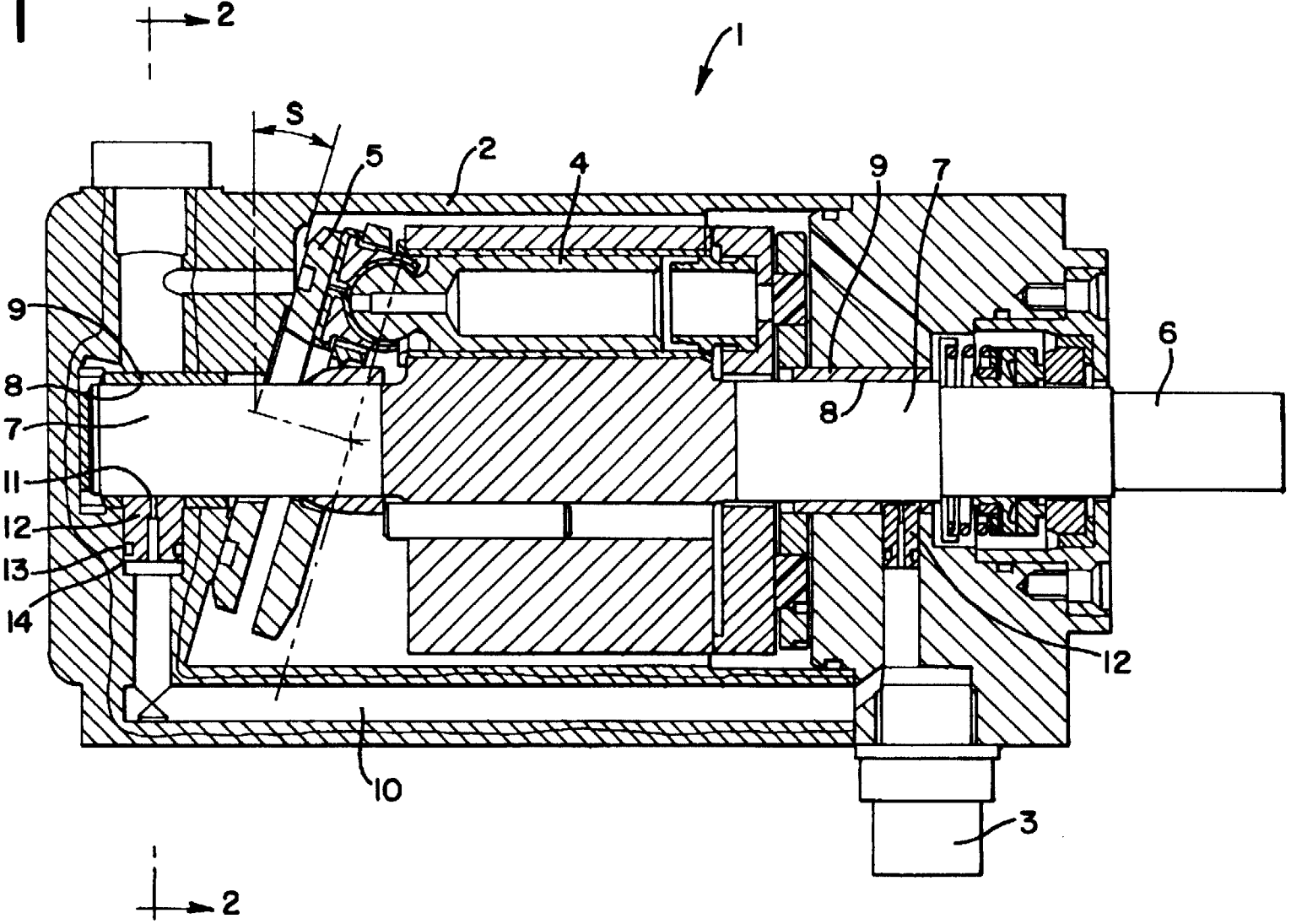
FIG. 1 shows an axial piston motor according to the present invention, FIG. 2 a section along the line II—II in FIG. 1, FIG. 3 diagrammatically a stationary, static loading condition of the radial journal bearing of the axial piston engine in operation, and FIG. 4 diagrammatically in radial section a radial piston motor according to the present invention.
Figure 2:
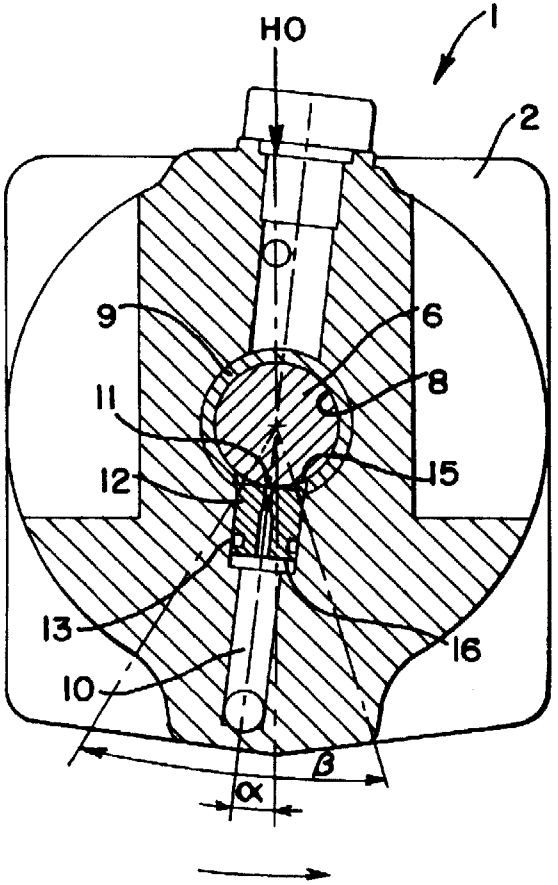

The axial piston motor 1 shown in FIGS. 1 and 2 comprises an enclosing housing 2, through which there is a flow .of lubricant-free, water-based pressure fluid such as corporation water, which is supplied via a pressure inlet 3. As shown diagrammatically in FIG. 3, the axial piston motor 1 may comprise five pistons 4, which via a known inclined disk construction 5 makes the drive shaft 6 of the motor rotate. Other numbers of pistons may be involved, however, because the idea of the invention concerns all piston engines regardless of the number of pistons.

In the embodiment shown, the drive shaft 6 is made of steel and comprises external sliding surfaces 7, which are supported against internal sliding surfaces 8 on the bearing liner 9 placed in the housing 2. For example, the bearing liners may be designed as a bushing of a highly stable thermoplastic material on polyetheretherketone basis reinforced with carbon fibre.

The housing 2 comprises a pressure fluid supporting duct 10, which ends at a recess 11 in a radially displaceable bearing part 12 in the internal sliding surface 8 in the bearing bushing 9. In the embodiment shown, the bearing part is shaped as a slide shoe or a pressure piston 12 of circular cross section, which is secured by means of an intermediary O-ring 13 in a radial bore 14 in the housing 2. The pressure piston 12 is preferably made of the same plastic material as the bearing bushing 9.

The pressure piston 12 comprises a bearing pressure rim or land 15, which delimits the recess 11 as well as a facing, hydrostatically actuated pressure surface 16, which acts on the pressure piston 12 with a force in the direction inwards towards the sliding surface 3 of the drive shaft 6.

Already at the starting the pressure fluid will be fed into the recess 11 to form a hydrostatic pressure fluid pocket, which will support the bearing surfaces when the drive shaft 6 begins to rotate.

Figure 3:
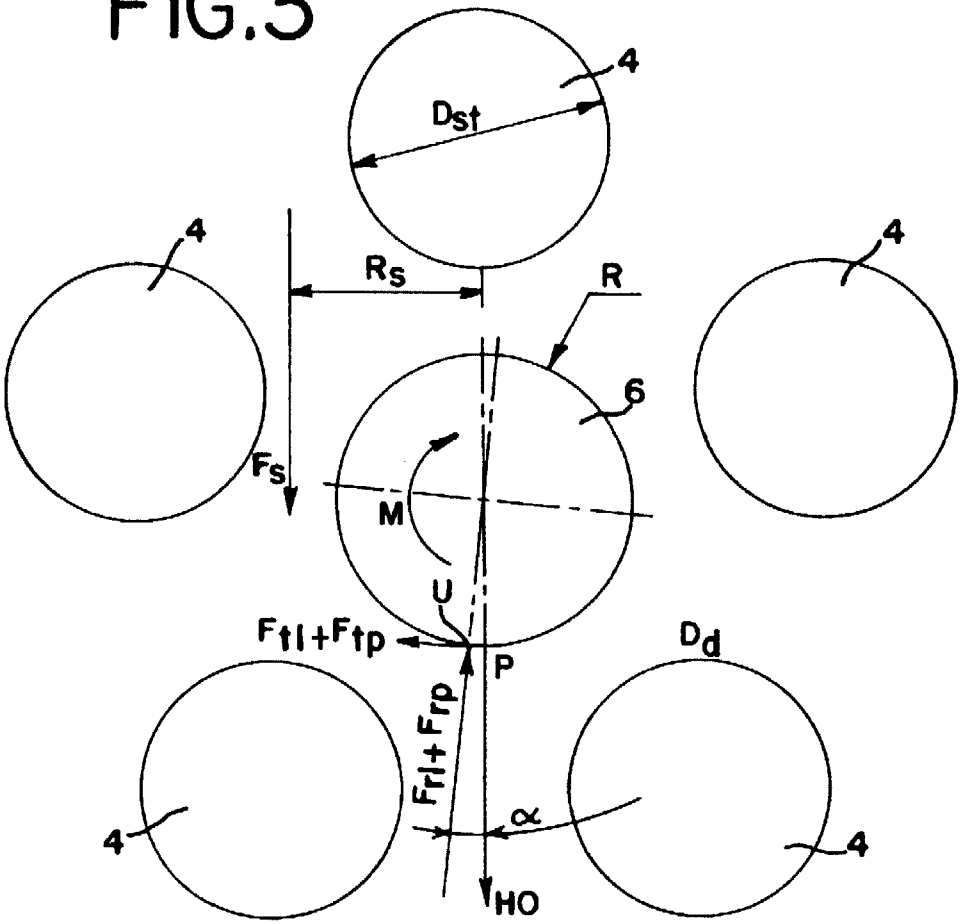

FIG. 3 shows diagrammatically the pressure pistons 4, which are distributed around the drive shaft 6. The axially directed force of the pressure pistons is converted on the inclined disk shown in FIG. 2 into a resulting, horizontal component $F_S$, see FIG. 3, which would mean that the journal bearing of the shaft is exposed to a radially directed load with the force $F_S$ in the point P. This force would involve an axially extended linear contact in the point P between the sliding surface of the shaft and the surrounding sliding surface.

In this case the point P lies diametrically opposite the vertex in the circular path of the pistons on the inclined disk.

However, the rotation of the shaft causes a certain friction in the journal bearing. The arrow M marked in the drawing indicates the torque load of the shaft; the direction of rotation is opposed, i.e. in the drawing the shaft rotates against the arrow M, and thereby counterclockwise. The friction in the linear contact P causes the shaft to tend to roll on the sliding surface connected to the housing in the journal bearing. The rolling would cause the linear contact P to wander clockwise around on the sliding surface connected to the housing, i.e. in the same direction as indicated by the arrow M.

The tendency towards rolling is equivalent to an addition of a frictional force to the radial force $F_S$. The frictional force is perpendicular to $F_S$ and points to the left in the drawing.

The superposition of the two forces causes the linear contact in the journal bearing not to occur in the point P, but in the point U, which is angularly displaced on the periphery of the journal bearing with the angle α in relation to the theoretical point of contact P.

Because of the actual linear contact in the point U, the journal bearing must exert a reactionary force, which is equal to the resulting force from the superposition of the force of the pistons and the frictional force.

The major part of this reactionary force is exerted by the hydrostatic pressure that is built up in the recess 11. The centre of the recess is placed so that it coincides with the point U. In the example shown, the recess is circular, so that the intersection with the cylindrical shaft gives the edge of the recess a curved, ellipsoid shape. Generally, the areal centre of gravity of the recess must lie angularly displaced in relation to the theoretical point of contact P, which is determined by the geometry of the engine without taking into account the frictional forces. Placing the areal centre of gravity of the surface in the point U results in the fact that there are "equal parts of relief surface" on both sides of the line where there is actually a tendency to linear contact.

It must be stressed that the discussion presented has been purely qualitative. In practice the presence of the recess causes a reduction of the friction. The reduced friction of the recess must therefore be included in the calculation in order to find the optimum angle α.

The tangential or circumferential extent β of the recess 11 covers at least an angular area comprising the geometrical extremities in the high-load area for the transmission of the piston forces to the bearing surface 8 via the drive shaft 6 at the lowest, respectively the highest number of pressure actuated pistons for the motor in question during operation.

FIG. 3 shows diagrammatically the parameters which have an influence in determining the angle α.

$R_S$; effective radius for the centre of force of pistons, $F_S$; vertical component of piston forces, dependant on:

$D_{st}$ piston diameter,

R; radius of bearing surface,

Δp; pressure drop in pump, and

S; angle of inclined disk.

M; indicates torque stress of drive shaft.

Thus the bearing surface of the pressure piston 12 is actuated by the following forces:

$F_{rp}$; support at the rim 15 of pressure surface, $F_{rl}$; support at pressure pocket 11.

At the bearing surface the pressure piston 12 is actuated by the following frictional forces:

$F_{tp}$; frictional force at the rim 15 of pressure surface, $F_{tl}$; frictional force at pressure pocket 11.

The following relation can be set up for the mutual influence of forces between the bearing surfaces, where $\mu_{st}$ indicates the static coefficient of friction:

$$F_{tl}=F_{rl}\times\mu_{st},\ F_{tp}=F_{rp}\times\mu_{st}.$$

Thus, experiments have been made with a hydrostatic, axial piston pump driven with water and with the following parameters:

Δp=140 bar, $D_{st}$=15.7 mm, S=16°, $D_d$=45 mm, R=9 mm.

The pressure piston 12 had an external diameter at the rim 15 of the pressure surface of 12.2 mm and an internal diameter of 10 mm (corresponding to the extent of the recess 11).

It was established by experiments that the angular displacement α should be at maximum at high static friction coefficients $\mu_{st}$, and at minimum at low static friction coefficients $\mu_{st}$. By varying the composition of materials for the radial journal bearing of the axial piston motor in question, the following intervals were established:

α=0°–4° and $\mu_{st}$=0–0.1

α=2°–6° and $\mu_{st}$=0.1–0.2, and

α=3°–8° and $\mu_{st}$=0.2–0.3.

At $\mu_{st}$=0.3, $\beta_{min}$=6° has further been established for the axial piston motor in question. This angle area for β covers the geometrical extreme points in the high-load area for the transmission of piston forces to the bearing surface via the drive shaft, when there are two pistons, respectively three pistons which are pressure actuated for the motor in operation.

At the experiments an essentially improved support of the drive shaft was established by the angularly displaced position of the pressure piston, with an especially reliable motor as a consequence.

The dimensioning with a view to $\mu_{st}$ was chosen in order to optimise the starting torque of the motor. For optimation of the operational torque, the dimensioning should be based on the dynamic coefficient of friction.

Figure 4:
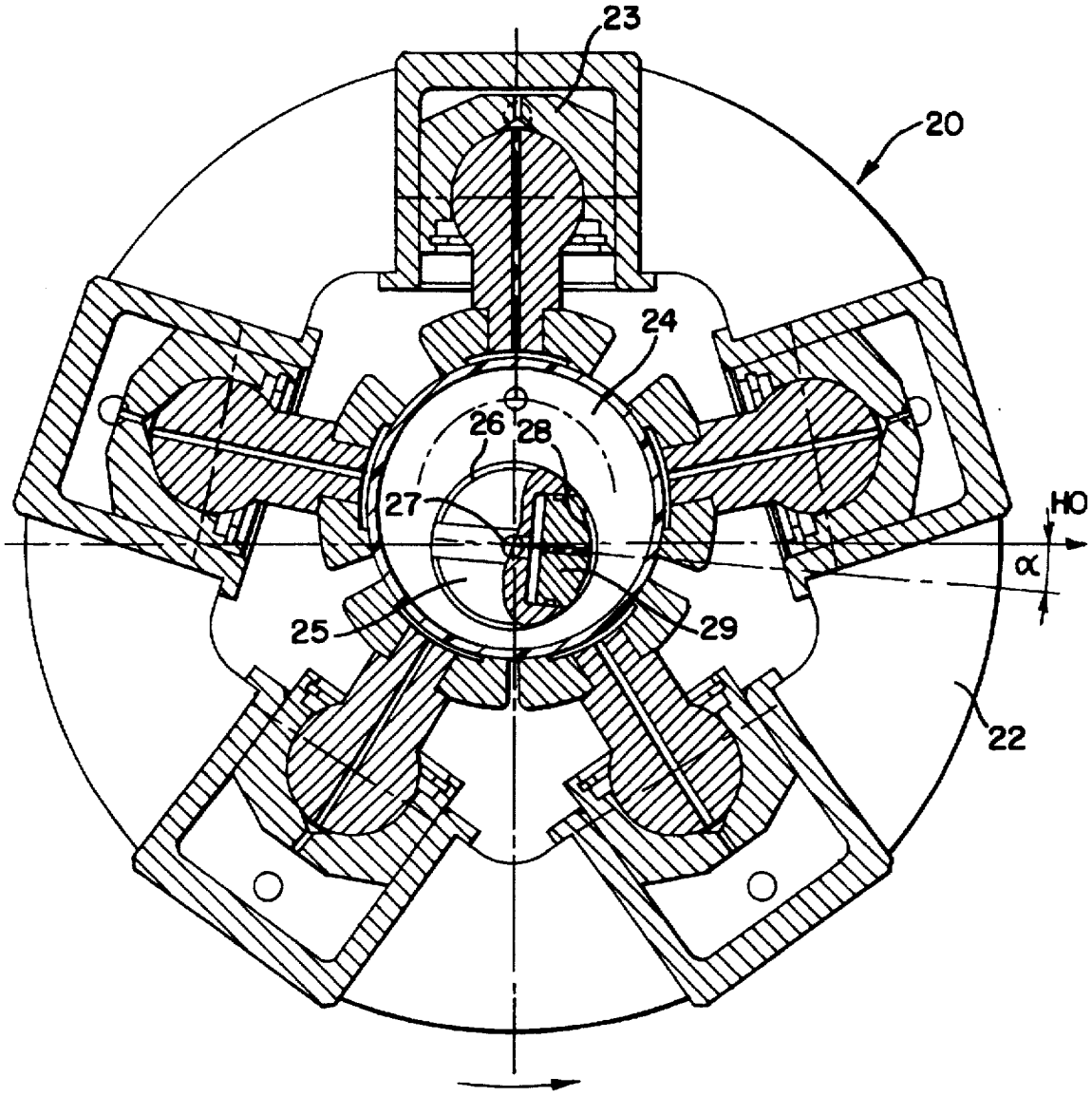

The radial piston motor 20 shown diagrammatically in FIG. 4 comprises an enclosed housing 22, through which there is a flow of lubricant-free, water-based pressure fluid such as corporation water. The radial piston motor may comprise an optional number of pistons such as five pistons 23 in the embodiment shown. Via an eccentric part 24 the pistons 23 are connected drivingly to the drive shaft 25 of the rotor. In the embodiment indicated, the drive shaft 25 is made of steel and is supported in bearing bushings 26 of a highly stable plastic material, which are supported in the housing 22.

The drive shaft 25 comprises a pressure-fluid supplying duct 27, which leads to a recess 28 shaped in a radially displaceable pressure piston 29 in the drive shaft 25.

The geometrical pressure mean point P for pressure actuation of the radial piston motor 20 is indicated in the high-load area for the transmission of the piston forces $F_S$ to the bearing surface at the drive shaft 25. Thus there is a mean point P, which in a known manner can be established geometrically for the engine construction in question, depending on the number of pistons of the construction. The approximate centre of the radial extent of the recess on the bearing surface is angularly displaced by the angle α in the direction against the direction of rotation of the drive shaft 25, seen in relation to the mentioned geometrically determined mean point P of the pressure actuation. The angle α lies in the area 0°–25° and increases with an increasing static friction coefficient $\mu_{st}$ between the bearing surfaces.

Many changes can be made without deviating from the idea of the invention. In the embodiments shown, the recesses are placed in pressure pistons, but the recesses may also be shaped direct in the bearing surface in question.

We claim:

1. A hydraulic piston engine for operation with a lubricant-free, water-based pressure fluid, having a rotatable shaft which is coupled to work pistons and which is journalled in a housing in at least one radial journal bearing, in which a first sliding surface of metal faces a second sliding surface of plastic material, including, in the journal bearing in a load area, which is continuously loaded during operation by the influence of the work pistons with a radial force $(F_{rl})+F_{rp})$, at least one recess shaped in one of the sliding surfaces, which recess is supplied with pressure fluid during operation for at least partial absorption of the radial force, and the recess having an areal center of gravity being angularly displaced an angular displacement ($\alpha$) in a direction against the direction of rotation of the shaft in relation to a certain position determined by geometry of the engine, which position indicates the areal center of gravity for an area where the radial load ($F_S$) from the work pistons would exist on the second sliding surface, if the journal bearing was without friction and without said recess.

2. A hydraulic piston engine according to claim 1, in which the angular displacement ($\alpha$) is larger than 0° and less than 25°.

3. A hydraulic piston engine according to claim 1, in which the angular displacement ($\alpha$) is dependent on a static friction coefficient ($\mu_{st}$) of the journal bearing.

4. A hydraulic piston engine according to claim 1, in which the angular displacement ($\alpha$) is dependent on a dynamic friction coefficient ($\mu_{dy}$) of the journal bearing.

5. A hydraulic piston engine according to claim 1, in which the angular displacement ($\alpha$) is dependent on a friction coefficient ($\mu$), which lies between a dynamic friction coefficient ($\mu_{dy}$) of the journal bearing and a static friction coefficient ($\mu_{st}$) of the journal bearing.

6. A hydraulic piston engine according to claim 1, in which the journal bearing has a static or a dynamic friction coefficient ($\mu_{st}$, $\mu_{dy}$), which is larger than 0 and less than 0.3, and the angular displacement ($\alpha$) is larger than 0 and less than 8°.

7. A hydraulic piston engine according to claim 1, in which during operation the rotatable shaft is influenced by a force ($F_S$), having at least one of a magnitude and direction varying with a varying number of work pistons, which work pistons are permanently pressure loaded, and in which the angular displacement ($\alpha$) is dependent on a largest occurring force ($F_S$).

8. A hydraulic piston engine according to claim 1, in which the rotatable shaft is influenced during operation by a force ($F_S$), having at least one of a magnitude and direction varying with a varying number of work pistons, which work pistons are permanently pressure loaded, and in which the angular displacement ($\alpha$) is dependent on a smallest occurring force ($F_S$).

9. A hydraulic piston engine according to claim 1 in which the rotatable shaft is influenced during operation by a force ($F_S$), having at least one of a magnitude and direction varying with a varying number of work pistons, which work pistons are permanently pressure loaded, and which the angular displacement ($\alpha$) is dependent on the force ($F_S$), which lies between a smallest occurring force and largest occurring force.

10. A hydraulic piston engine according to claim 1, in which the rotatable shaft is influenced during operation by a force ($F_S$), having at least one of a magnitude and direction varying with a varying number of work pistons which work pistons are permanently pressure loaded, and in which the recess covers at least an angular range ($\beta$), which comprises an extreme for the influence of the force ($F_S$) on the sliding surface.

11. A hydraulic piston engine according to claim 1, in which the recess is supplied with pressure fluid via a throttle device.

12. A hydraulic piston engine according to claim 11, in which the throttle device comprises a throttle duct, which leads to the recess.

13. A hydraulic piston engine according to claim 11, in which the recess is formed in a movable slide shoe, the recess being surrounded by a land shaped on the slide shoe, which forms part of a sliding surface.

14. A hydraulic piston engine according to claim 7, in which the throttle device comprises a throttle duct formed in the slide shoe.

15. A hydraulic piston engine according to claim 14, in which the slide shoe is a cylindrical piston, which is slidingly fixed in a bore, which leads to one of the bearing surfaces.

16. A hydraulic piston engine according to claim 15 in which the cylindrical piston has a first end surface in which the recess and the land are formed, and a facing, second end surface which has an inlet to the throttle duct and which is influenced during operation by pressure fluid which is conducted to the bore.

17. A hydraulic piston engine according to claim 1, where the shaft is rotatable in relation to the work pistons, and in which the recess is located in a sliding surface on the shaft, and the shaft comprises at least one passage connected with the recess for supplying pressure fluid to the recess.

18. A hydraulic piston engine according to claim 1, where the work pistons revolve with the shaft in relation to a stationary housing, and in which the recess is located in a sliding surface in the housing, and the housing comprises at least one passage connected with the recess for supply of pressure fluid to the recess.

19. A hydraulic piston according to claim 1, in which the plastic material is a polyarylether ketone.

20. A hydraulic piston engine according to claim 1, in which the plastic material is polyetherether ketone.

21. A hydraulic piston engine according to claim 1, in which the plastic material is referenced with fibres.

* * * * *